United States Patent [19]

Othmer

[11] 3,938,988

[45] Feb. 17, 1976

[54] METHOD FOR PRODUCING ALUMINUM METAL FROM ITS SALTS

[76] Inventor: Donald F. Othmer, 333 Jay St., Brooklyn, N.Y. 11201

[22] Filed: Aug. 7, 1973

[21] Appl. No.: 386,411

Related U.S. Application Data

[63] Continuation of Ser. Nos. 103,765, Jan. 4, 1971, Pat. No. 3,793,003, and Ser. No. 308,059, Nov. 20, 1972, Pat. No. 3,853,541, and Ser. No. 370,310, June 15, 1973, Pat. No. 3,861,904.

[52] U.S. Cl. ..... 75/10 R; 75/68 R; 75/68 B; 204/164

[51] Int. Cl.[2] ..... C22B 4/00

[58] Field of Search ..... 75/68 R, 68 B; 204/164; 95/10 R

[56] References Cited

UNITED STATES PATENTS

| | | | |
|---|---|---|---|
| 2,768,074 | 10/1956 | Stauffer | 75/10 R |
| 2,938,783 | 5/1960 | Ustan | 204/164 X |
| 2,978,316 | 4/1961 | Weir | 204/164 X |
| 3,533,777 | 10/1970 | McTaggart | 75/10 R |
| 3,658,673 | 4/1972 | Kugler et al. | 204/164 |
| 3,708,409 | 1/1973 | Bainbridge | 204/164 |

*Primary Examiner*—Herbert T. Carter

[57] ABSTRACT

Aluminum metal in the gaseous state may be produced by breaking down of its salts at temperatures of at least 2500° to 5500°C. These very high temperatures may be reached in various ways, e.g., by producing a thermal plasma by means of a plasma arc or a plasma torch. There results a mixture of the two elemental gases; and the separation of the mixture is accomplished by instananeously chilling the hot gas stream from such a heater to a temperature of 136° to 1500°C in a "flash" cooler by contacting it directly with a liquid coolant, separately cooled. The liquid coolant may comprise the same aluminum salt as is fed to the plasma system; or it may be a solution of that compound with one or more other liquids, which solution may have a melting or boiling point in a desired temperature range; or it may be a quite different compound or compounds. The aluminum produced may be withdrawn as a liquid; or if the flash condenser operates below the melting point of aluminum, it may be obtained as a slurry of fine granules in the liquid coolant. The other elemental gas may pass through the liquid of the flash condenser uncondensed.

20 Claims, No Drawings

METHOD FOR PRODUCING ALUMINUM METAL FROM ITS SALTS

This application is a Continuation in Part of copending Applications: - (a) U.S. Ser. No. 103,765 of January 4th, 1971 now Patent No. 3,793,003, (b) U.S. Ser. No. 308,059 of November 20th, 1972 now Patent No. 3,853,541, and (c) U.S. Ser. No. 370,310 of June 15th, 1973 now Patent No. 3,861,904, all having the same title, *Method for Producing Aluminum Metal Directly from Ores*, and all referred to hereinafter as the copending applications.

At the high temperatures of at least 2500° to 5500°C, such as those obtained in a thermal plasma generated by a plasma arc or a plasma torch, many salts of aluminum with a single other element break down into the two elements. These may be discharged as a gaseous mixture containing the two elements. The aluminum salts may have as the other element sulfur or one of the three lower halogens, particularly fluorine, chlorine, and bromine. The iodide may be used, but does not lend itself to the necessary recycle of the halogen. Aluminum selenide may be used but is very expensive; and the salt-like aluminum carbide also may be used, sometimes with modifications.

Within a very short interval of time, preferably from one-thousandth to one-tenth of a second and always in less than one to five seconds, the hot gaseous products from the breakdown of the aluminum compound are quenched, or cooled to a lower temperature of 136° to 1500°C by a flash condenser using a coolant liquid, separately cooled. The aluminum may be condensed from this mixture of the elemental gases as a liquid or solid obtained with the coolant liquid. The other element also may be obtained usually in a gaseous form which will allow its ready separation from the aluminum and from the coolant liquid.

While other aluminum salts may be prepared from the aluminous ore by conventional methods or as described in the copending applications, and then used as the starting material for the process of this invention, aluminum chloride may be considered as typical. Copending application U.S. Ser. No. 103,765 now U.S. Pat. No. 3,743,003 describes a convenient method for producing pure aluminum chloride and aluminum metal from many ores and wastes from ore processing operations.

Copending application U.S. Ser. No. 308,059 now U.S. Pat. No. 3,853,541 describes how aluminum trichloride, $AlCl_3$, may be converted to aluminum monochloride, AlCl, at a temperature above 1000°C. The AlCl in turn may be disproportioned at a temperature below 1000°C to give aluminum metal and aluminum trichloride. It describes also how the hot gases carrying the monochloride are quenched so rapidly by contact with a chilled liquid that aluminum metal is obtained as such without allowing time for its reaction with the gases.

The present invention may start with the aluminum trichloride as a typical aluminum salt. It may be prepared as described in the copending applications, or in any other manner. By heating it to a high temperature of at least 2500°–5500°C, it is broken down into its elements, either directly or via aluminum monochloride. At the high temperatures of this range, the chlorine breaks from its compound with aluminum in the atomic state. It may come: - (a) directly as such, i.e., Cl, by the breaking down of $AlCl_3$; (b) via AlCl; or (c) via the usual molecular form $Cl_2$ broken off from either of the aluminum chlorides. In any case, the atomic chlorine which is stable only at these very high temperatures is extremely reactive as it cools; and the quenching to a comparatively low temperature must be done practically instantaneously to prevent the chlorine from reuniting with the aluminum. Also, since Cl is so reactive, the chilled liquid coolant must be one with which Cl will not react; thus a chloride salt has been found most desirable.

The quenching is done by flash cooling and condensation, similar to the method of copending application U.S. Ser. No. 308,059 now U.S. Pat. No. 3,853,541. While the temperature of the gases is much greater, i.e., at least 2500° to 5500°C in the present invention, as against 1200° to 1800°C in U.S. Ser. No. 308,059 now U.S. Pat. No. 3,853,541, the mass — and usually the volume — of the gas reactive to aluminum which must be handled per mol or per pound of aluminum produced will be very much less. In both cases, it is most essential to minimize contact of the aluminum metal formed, in either a solid or liquid state, with the hot gas also being cooled because of the great reactivity for each other of the components of the mixture. In the present invention, the gases may be even much more reactive, and are initially at a very much higher temperature; however, they are usually much smaller in mass (or volume) per pound of aluminum produced because little, if any, other gases are present than those of (a) aluminum, (b) the other element, (c) the unreacted salt. A carrier gas (inert) may be used in some cases; but usually it is not necessary.

By controlling the conditions in the higher temperature reactor, a greater or lesser breakdown of the aluminum salt is obtained. If a substantial part of the salt comes through unchanged after condensing, it may act as the liquid coolant, providing it forms a liquid phase. As always, one of the important functions of the coolant liquid is to cover the liquid or solid aluminum formed to protect the particles or droplets from direct contact with the other elemental gas, and thus minimize a backward reaction.

It is particularly important to select as a first consideration, the operating temperature of the flash cooler. Usually this depends on the choice of the boiling point of the single liquid, or of the liquid mixture used as the liquid coolant. If it has a boiling point below the melting point of aluminum, solid particles of aluminum are obtained; if it has a boiling point above the melting point, liquid aluminum is obtained. Because the liquid aluminum droplets formed may be agglomerated into a liquid mass, this may have much less surface area exposed for reaction to the other element in the gas phase, e.g., chlorine, than that of the very small solid particles formed at a lower teperature. Thus, it has been found that, besides the obvious mechanical advantages of removing aluminum as a liquid, the metal actually may be recovered in a higher yield from the starting binary compound, even though the higher temperatures would tend to accentuate the reconversion of the aluminum with the other element back to the original salt.

There are major advantages to use, when possible, as the liquid coolant, the salt which is being broken down. Some aluminum salts have no liquid phase under atmospheric pressures, but often may be dissolved in another liquid and the solution used as the coolant liquid.

In some cases, there can be used as the flash condenser a conventional coil or other tubular condenser, chilled by flowing a secondary chilling liquid inside. This would be the case when the aluminum salt was not completely broken down into its elements. Some of the salt then comes from the high temperature reactor in the gas stream, and on condensing on the coil gives a film, or thicker layer, of condensate which acts as the coolant liquid for instantly cooling the subsequently flowing hot gas stream.

This use as coolant liquid of the salt which is being broken down has the additional advantage that some part of this liquid coolant, after removal of the aluminum and the other element, may be passed back to and used directly as feed stock to the high temperature reactor.

The coolant has an important function after condensing the aluminum, in covering the aluminum particles to minimize contact and hence interaction with the other elemental gas.

OBJECTS OF THE INVENTION

Some objects and accomplishments of the invention are: - a. the ready winning of aluminum from its salt with some other particular element, which compound, in turn, may have been readily formed from many ores and ore residues which are not amenable to separation by conventional technology;

b. the production of aluminum by the heating of a salt with a single element to a temperature high enough to break it into its elements, and the near instantaneous cooling of the resulting gas mixture to separate the elements before they can recombine;

c. the use of a thermal plasma torch or thermal plasma arc and a flash condenser to accomplish the respective heating and cooling steps;

d. the use of a cooling liquid in the flash condenser which is composed, at least in part, of the binary salt which is being broken down to give aluminum;

e. the use of a liquid coolant in the flash condenser which is composed, at least in part, of a salt of another metal with the same element as is in the aluminum salt and more reactive therewith than is aluminum. This added salt is present in a solution of the two salts, a mixed crystal, or a compound with the aluminum salt;

f. the removal of the heat given up by the hot gases in the flash condenser as latent heat of evaporation of the coolant and then as latent heat of condensation in a second or reflux condenser;

g. the separation of substantially pure aluminum metal from the coolant liquid of the flash condenser;

h. when the original binary aluminum salt is used by itself or as a volatile constituent of the cooling liquid, the use of its vapors arising from the flash condenser directly in the high temperature reaction wherein this salt is broken down into its elements.

OPERATION OF THE INVENTION

The high temperatures required to break down binary salts of aluminum are most readily obtained in thermal plasma torches or furnaces of the induction or arc type. The salt is fed as solid, liquid, or gas to this or other heating unit of one of the several or more types available as standard equipment. The high heat flux is controllable within the desired limits of 2500° to 5500°C; and the gaseous mixture of the elemental gases at the high temperature is almost instantly discharged to be chilled immediately in the flash cooler, also of prior art design and operation, and utilizing a liquid coolant. The elemental gas mixture is stable at the high temperature; but to separate the aluminum from the other element in the gas without recombination, it must be chilled to condense the aluminum out as droplets or fine particles within a very short time, preferably within not more than 0.001 to 0.1 second, and in no case in more than 1 to 5 seconds. Usually the amount of recombination goes up rapidly and the yield of aluminum metal goes down rapidly with increase of time within these limits.

The other element leaves the flash cooler with vapors from the coolant liquid and passes to the reflux condenser, if heat is removed by boiling the liquid coolant. The vapors condense; the condensate is returned to the flash condenser; and the other element is separated and recycled to combine with alumina in the original ore.

The amount of the liquid coolant in the system must be augmented from time to time to balance any minor mechanical losses. If the temperature of the liquid coolant is above the melting point of aluminum, liquid aluminum is withdrawn. If solid particles are frozen out, they are withdrawn in a slurry with the liquid, and separated by centrifuging. Alternatively, the liquid coolant may be dried off or extracted off of the solid particles.

The stability of the several aluminum halides decreases with increase in atomic weight of the halogen. Thus, aluminum fluoride has been found to require a temperature above about 4400°C before it breaks down, aluminum chloride above about 3300°C, and aluminum bromide above about 3000°C. The corresponding breakdown temperature of aluminum sulfide is about 3400°C. In practice, it is desirable to increase these temperatures at least 250° to 750°C so as to increase the reaction rate and insure the desired high production of the aluminum metal.

Salts of the alkali metals or alkali earths break down at higher temperatures than the corresponding aluminum salts. Thus, if the similar salts of these metals are used in the liquid coolant along with the aluminum salts; and if some part is recycled through the high temperature reactor, the temperature of the latter may usually be controlled to prevent the breakdown of the salt of the other metal which comes through as a vapor, while the aluminum salt is almost completely broken down.

Various heat interchanging devices which are known to the art may be used for economy; and these are not part of the invention. Also, other means than plasma of heating the aluminum salt up to the desired high temperature may be available. Such other heating methods and the methods of generating or using thermal plasmas per se, are also not a part of this invention.

FLASH COOLING AND CONDENSATION

A chemical reaction, particularly if homogeneous in the gas phase, as is the breaking down of a binary compound of aluminum, e.g., a chloride, may give at a high temperature the maximum yield of a desired product, here aluminum. However, in other cases the product may decompose if kept at this high temperature; or, even if the products are elements as in this invention, the high yield may be lost in large part on cooling due to the occurrence of reverse or other reactions which take place at intermediary temperatures on cooling the reaction products. A preferred system of overcoming this is by instantaneous or flash cooling of the product gases, including condensation of some or all of the vapors or gases present. Here, the elemental gases may be permanent, or essentially so. Many types of flash cooling equipment have been devised and used; often these provide direct and intimate contact with a liquid very much colder than the hot gas stream.

In the reversible gaseous reactions described in the copending application, U.S. Ser. No. 308,059 now U.S. Pat. No. 3,853,541, there is first an aluminum subchloride formation, then the aluminum metal production therefrom. However, when these reactions follow the reduction-chlorination of alumina in ores, the non-condensible gases present, CO, also $CO_2$, $O_2$, possibly $Cl_2$, will unite with the Al metal formed on cooling to give the carbide, the oxide, and/or the chloride, and thus will defeat the production of Al.

Flash cooling the gaseous reactants maximizes the amount of Al recovered by cooling the reactants rapidly and thus quenching the reaction at the appropriate time and temperature to secure, desirably, the same high yield of Al as at the high temperature. The hot gases are contacted intimately with a liquid coolant in some form of dispersed flow. For example, in the prior art, a spray of droplets of liquid aluminum gives direct contact with the hot reactants in a condenser at about 700°C — just above the melting point of Al metal, and considerably below the optimum reaction temperature of the gases of 1500°C to 1800°C for the production of AlCl. The heat is removed from the molten aluminum by a heat exchanger, to be passed to another fluid at a lower temperature.

The extremely large surface area of droplets of liquid aluminum used in the flash condensers of the prior art gives an excellent heat transfer surface for cooling; however, at this temperature of 700°C a very large surface area of aluminum is presented to the reactive gases, which is many times that of the surface of the aluminum metal condensing out for the first time. The copending application U.S. Ser. No. 308,059 now U.S. Pat. No. 3,853,541, shows that the aluminum so exposed with this large surface area, reacts at any temperature at which it is liquid with the reactive gases, to reduce greatly the net production of aluminum metal. In the use of a flash condenser in the present invention, dispersed aluminum metal would react with the nascent other element of the salt even more rapidly.

The droplets are formed by an agitator rotating rapidly and partially submerged in liquid aluminum — a "splash" condenser; or a spray of the cooling liquid is forced through a jet by a pump. The pump is more difficult to maintain than the open agitator if the liquid coolant freezes at a temperature higher than ambient. These splash, spray, or other type of direct contact condensers for flash cooling, are well known; and their designs are not a part of this invention. Still another processing contacts the hot gases with films of liquid coolant, descending — as over the packing shapes in a distilling column; or if the liquid coolant is suitable; for example, if it is the pure salt which is being broken down and is present in the hot gas stream, it may be a liquid film of condensate on the outside of a coil or other tubular condenser, through which a secondary cooling liquid is being circulated.

$AlCl_3$ AS COOLANT LIQUID FOR CONDENSING Al FROM BREAKDOWN OF $AlCl_3$

The copending application of U.S. Ser. No. 308,059 now U.S. Pat. No. 3,853,541 showed that liquid $AlCl_3$, either alone or in combination with another metal halide in the liquid phase, is better than molten aluminum or any other material as the direct coolant liquid in dispersed flow, spray, film, etc. to "quench" the reactions described therein. Furthermore, it was found desirable to remove the heat as latent heat in a boiling operation rather than as sensible heat to a cooler fluid, to obtain some advantages in design and operation of the flash condenser.

$AlCl_3$, which sublimes at about 180°C, has many advantages as the direct contact coolant for this purpose; but it cannot be used by itself at atmospheric pressure because it condenses as a solid, and, as such, does not lend itself to a system using a dispersed condensed phase. However, $AlCl_3$ may be used as a liquid in a flash condenser operated at a temperature and vapor pressure above its triple point of 192.6°C and 2.2 atmospheres: — e.g., at 220°C the vapor pressure of liquid $AlCl_3$ is about 3.5 atmospheres.

By operating the condensation-cooler under pressure for the removal of the aluminum formed in the disproportionation, $AlCl_3$ was used as the coolant in the copending application U.S. Ser. No. 308,059 now U.S. Pat. No. 3,853,541. This imposed a major difficulty in that the disproportionation reactor also had to be operated under pressure in order that the hot gases therefrom could be passed immediately to the cooler.

Similarly, in the present invention, $AlCl_3$ has been found to have the same desirable properties and the same disadvantages when used as the coolant in the flash condenser. However, even at several atmospheres pressure, the boiling $AlCl_3$ cools the mixture from the high temperature reactor to give chlorine and aluminum at a much lower temperature than may be necessary; and particularly it gives solid aluminum. Also, the reactor for breaking down $AlCl_3$ is difficult to operate at a temperature of 2500°C–5500°C under several atmospheres pressure presents; and preferred modication is demonstrated later.

As in other cases, the cooling of the very hot gases has been found to give the highest yields of aluminum, if accomplished within a time of only from 0.001 to 0.1 of a second; although operative results may be obtained if the time of cooling is in the range of one to five seconds.

$AlBr_3$ as COOLANT LIQUID FOR CONDENSING Al FROM BREAKDOWN OF $AlBr_3$

It was also found in the copending application U.S. Ser. No. 308,059 that, if bromine is used as the other element in an aluminum compound, this $AlBr_3$ may then be converted to AlBr; and by disproportionation of it, aluminum metal is obtained. The $AlBr_3$ was used also as the liquid coolant; and it melts at 97°C and boils under one atmosphere pressure at 263°C.

In the present invention, it can be used in a liquid spray condenser or other flask condenser operating at atmospheric pressure.

Again, the same advantages and disadvantages have been found in its use as a coolant for the hot, elemental gases coming from a reactor at 2500° to 5500°C. for breaking down the same $AlBr_3$ into its elements by one or more steps.

The very large amount of heat given up is readily absorbed as latent heat by the $AlBr_3$ which boils; and the vapors are condensed in what amounts to a reflux condenser. The modular bromine which is formed from the atomic bromine on cooling is a non-condensible gas at this temperature; and it passes through the condenser to be collected for reuse. A duct of minimum length and diameter carries the hot gases from the reaction to the flash condenser so that the time is minimized to cool the elemental aluminum and bromine in the gas stream from the high reaction temperature down to the normal boiling temperature of $AlBr_3$ — 263°C. This time of cooling of the hot gases must not be more than 1 to 5 seconds; and the best yields of the product Al were obtained when this time was in the range of 0.001 to 0.1 second.

The hot gases from the reactor may discharge immediately into a chamber below the reflux condenser so that the condensate therefrom falls as droplets or films down and over packing shapes to give, as an extensive cooling-contacting surface, the films over the packing shapes for the contact of the relatively much lower temperature liquid with the hot gases.

If the reactor is operated under conditions which are less than optimal, i.e., at a lower temperature or lower time of contact, some $AlBr_3$ or AlBr will be in the hot gases, which may then impinge directly on a coil or other arrangement of cold tubes acting as the reflux condenser and chilled by water or other fluid. A film of cold $AlBr_3$ is condensed as such or disproportioned from the AlBr with accompanying formation of aluminum. This very cold film of $AlBr_3$ on the tubes, or a thicker layer if a shallow trough is used around the tubes, serves as the liquid coolant in contact with the mass of the hot gas from the reactor. The aluminum comes as such fine solid particles that the liquid $AlBr_3$ washes it off the surface to be separated from the coolant.

The aluminum crystallizes to a powder which makes a slurry in the liquid $AlBr_3$ salt, which was separated by physical means from the aluminum metal product for reuse in the flash condenser, i.e., by decantation or distillation. Thus, the slurry may be heated below the condenser zone to evaporate the $AlBr_3$ therefrom. A heavy sludge of Al in $AlBr_3$ is withdrawn and further heated so as to dry the metal particles completely, thus giving $AlBr_3$ vapors which are passed back to the same reflux condenser. The heating is continued to melt the aluminum for casting into slabs.

$AlBr_3$ is the simplest of the halide salts or solutions to use as the liquid coolant; and as it is typical in some of the operations involved, these may be considered. The coating by the $AlBr_3$ liquid minimizes the contact of the aluminum metal particles formed and thus their interaction with the bromine at the low temperatures which are obtained and maintained by the instantaneous boiling of the $AlBr_3$. This is aided by the excellent heat transfer relations. The yield of product aluminum is higher than if the temperature was at the melting point of aluminum; i.e., 660°C or somewhat above (690°–700°C) when a higher boiling coolant is used to give a liquid product.

Bromine costs several time as much as chlorine. However, no bromine need be expended in this cycle; and if that which also cycles with the other elements with which it combines in the ore is entirely recovered, the cost is merely that of the inventory in the operation, and this would be unimportant. In no times can there be more than a negligible loss from the operations to the surroundings because of the nuisance of the halogens, even in relatively small quantities. Some other advantages also accrue in using Br because it is more easily recovered from off-gases: — for example, Br, HBr, and $AlBr_3$ are all less volatile than the respective chlorine compounds; and the big advantage is that $AlBr_3$ may be used as a liquid at atmospheric pressure while $AlCl_3$ cannot, since it sublimes and condenses as a solid under atmospheric pressure.

SOLUTIONS OF $AlCl_3$ WITH CHLORIDES OF METALS HIGHER THAN Al IN THE AFFINITY SERIES

Other chlorides were found useful in copending application U.S. Ser. No. 308,059 now U.S. Pat. No. 3,853,541 when used in conjunction with $AlCl_3$ as the coolant liquid for the direct contact cooling and condensing at atmospheric pressure of a hot gas mixture. These other metal chlorides maintain the $AlCl_3$ in a liquid phase and effectively reduce its vapor pressure so that it vaporizes at a temperature above its normal sublimation temperature of 180°C.

Particularly useful in the present invention also are solutions of the chlorides which chemically combine with $AlCl_3$; also of various physical mixtures of $AlCl_3$ with the chlorides of alkali and alkaline earth metals, LiCl, KCl, NaCl, $CaCl_2$, and $MgCl_2$; also with chlorides of other metals which are also higher than chlorine in the chlorine affinity series.

The chlorine affinity series of metals lists the order of the reactivity of their oxides for chlorine and has been described for some thirty-one elements in the copending U.S. Ser. No. 308,059 now U.S. Pat. No. 3,853,541.

Mixed salts are formed with $AlCl_3$ by many of the chlorides or other metals higher than aluminum in the chlorine affinity series. However, these solutions also may be regarded as simply binary (or ternary or even quaternary) liquid mixtures over wide ranges of the ratios of $AlCl_3$ present therein. In almost every case, some ratio of salts in these chemical or physical mixtures will give the $AlCl_2$ dissolved in a liquid phase at atmospheric pressure and at a suitable operating temperature for a splash condenser, i.e., between 100°C. and 500°C; or even as high as 700°C to 725°C, when it is desired to use a flash condenser which gives the Al as a liquid.

Such flash condensers may be used in the present invention similarly to their use in the copending application U.S. Ser. No. 308,059 now U.S. Pat. No. 3,853,541. Hence, these liquid mixtures of metal chlorides may be used as the liquid in a direct contact spray or splash condenser, as the direct contact heat transfer agent for cooling the elemental gases coming from the high temperature reactor, and the best mixture of these chlorides may be selected to give, on boiling, a suitably high concentration of $AlCl_3$ in the vapors, as desired. For example, the boiling points of the chlorides of the alkali and alkaline earth metals are high and their relative volatilities out of solutions with $AlCl_3$ are low, up to about 700°C–725°C where molten aluminum can be withdrawn as such.

However, pure $AlCl_3$ vapors give a solid condensate in a reflux condenser. Thus, the salt mixture chosen must boil to give vapors, the condensate of which is fluid at the temperature of the reflux condenser, if such is used.

It has been found that the boiling points of these binary, ternary, or quaternary liquid mixtures of $AlCl_3$ and chlorides of the alkali or alkaline earth metals may be varied, if desired, over a range from below the sublimation point of pure $AlCl_3$, 180°C, (and $AlCl_3 \cdot NaCl$ melts at this temperature), or even down to the melting point of $LiCl \cdot AlCl_3$, 144°C, to above the melting point of Al metal — so aluminum may be recovered in the liquid form.

The mixture of salts is chosen so that sufficient of the chloride of the other metal vaporizes to keep the $AlCl_3$ in the condensate in a liquid solution (since at atmospheric pressure $AlCl_3$ has no liquid state when pure). However, this is not always necessary since the heat taken up by the flash condenser may be removed from the mixture of chlorides by cooling coils immersed in the body or reservoir of the liquid salt mixture, or by other well known conventional system instead of by the reflux condenser arrangement which is usually preferred. The liquid melt would not then need to be boiling.

The advantages and disadvantages of the use of different such mixtures of $AlCl_3$ with other chlorides has been noted for the usage of the flash condenser in copending application U.S. Ser. No. 308,059 now U.S. Pat. No. 3,853,541; and they are substantially the same as in this invention. ($TiCl_4$ boils at 136° and gives the lowest practical boiling point). Also, the needs of any methods for separation of the $AlCl_3$ from the added chloride, have been noted in that copending application.

The Al metal, as the product of the system, comes as a slurry of fine powder if the liquid mixture of the chlorides boils below 690°, the melting point of Al, or as liquid droplets of Al, if above. In either case, the Al metal is separated by physical means; i.e., filtration from, or evaporation off of the $AlCl_3$, wherein the $AlCl_3$ is vaporized and dried off to pass back to the high temperature reactor. The other chloride is separated by its vaporization, away, or in some cases by melting the aluminum and withdrawing it as a liquid. Salts having a boiling point above 660°C, the melting point of the Al, may remain as a small amount of residual impurity to be removed as a solid mixture and dissolved off with water, recovered for reuse, or discarded.

Also, as an example, $CaCl_2$ may be added and maintained in sufficient quantity in its mixture with $AlCl_3$ in the flash condenser to give a temperature of the coolant liquid there of 700°C. The Al metal is then condensed as a liquid and settled to the bottom of the pool of molten salts from which it is withdrawn.

$AlF_3$ AS COOLANT LIQUID FOR CONDENSING Al FROM BREAKDOWN OF $AlF_3$

Aluminum fluoride also may be broken down into its elements by the process of this invention. However, by itself, it cannot be used as a coolant in a flash condenser at atmospheric pressure because it does not have a liquid phase, but instead, it sublimes at about 1275°C.

Its compound with sodium fluoride, cryolite, $Na_3AlF_6$, may be used as the liquid coolant above the melting point of cryolite at 1009°C. Cryolite, stoichiometrically contains some 40% $AlF_3$ by weight; and it dissolves an added amount of $AlF_3$ to give a eutectic, at a total of 64% $AlF_3$, which melts at 693°C. Several other fluorides and other salts also reduce the melting point of cryolite when dissolved therein. However, the low vapor pressure of these solutions in cryolite allows the use of a splash condenser which depends on boiling and condensing of the liquid only at temperatures of about 1200° to 1500°C. As with cooling of the liquid by cooling coils, there are some difficulties because of mechanical problems; but in both cases they may be surmounted.

If there is first operated a flash condensation using the boiling liquid at the temperature of 1200°–1500°C, a partial reconversion of some part of the aluminum with the fluorine to the monofluoride occurs in solution. There is, however, an advantage in not requiring as large a temperature drop in one step. With a subsequent cooling of this liquid to 700°–900°C, three molecules of this dissolved monofluoride disproportionates to one molecule of the trifluoride and two atoms of liquid aluminum for withdrawal. The aluminum trifluoride is recycled to the high temperature reactor.

$Al_2S_3$ AS COOLANT LIQUID FOR CONDENSING Al FROM BREAKDOWN OF $Al_2S_3$

Aluminum sulfide similarly may be broken down into its elements at the high temperatures of 2500°–5500°C; and aluminum metal is then condensed out of the gas stream in a flash condenser using $Al_2S_3$ mixed with a sulfide of an alkali or alkali earth metal as the liquid coolant. The sulfur vapor leaving the high temperature of the flash condenser is separately condensed for reuse.

$Al_4C_3$ TO GIVE ALUMINUM AND CARBON.

When the salt-like aluminum carbide is broken down into its elements at the lower end of the temperature range of the high temperature reactor of this invention, i.e. around 2500°C, the carbon formed comes as a very fine powder mixed in the coolant liquid in the flash condenser; and it is relatively stable to re-combinbination with the aluminum. At 4200°–5500°C, however, it is a gas, but in the flash condenser condenses to a solid. The various aluminum halides, their mixtures and compounds may be used for the coolant liquid as described above: — preferably at a temperature which gives liquid aluminum, so that the solid carbon which is formed may be separated easily.

I claim:

1. The process of producing aluminum from a salt containing aluminum and a single other element by steps comprising:

a. heating said salt to a high temperature of at least 2500°–5500°C to break it into aluminum and said other element in a mixture comprising the two elemental gases;

b. flash cooling said mixture comprising said two elemental gases from said high temperature, to a lower temperature of not over 1500°C within a time interval of not more than one to five seconds, by contacting said gas mixture directly with a coolant which is liquid at said lower temperature and is chemically nonreactive with said salt and its constituent elements in elemental form at said lower temperature; and c. condensing said aluminum in said liquid coolant while allowing said other element to pass on in a gas phase.

2. In the process according to claim 1, wherein the boiling point of said liquid coolant is between 136° and 1500°C.

3. In the process according to claim 1, wherein said other element is sulfur, and said aluminum salt is aluminum sulfide.

4. In the process according to claim 1, wherein said high temperature reaction and said flash cooling both take place under a pressure higher than that of the atmosphere.

5. In the process according to claim 1, wherein said liquid coolant comprises said original aluminum salt and sufficient of at least one other salt dissolved therein to form a liquid solution therewith at said lower temperature, said other salt being chemically non-reactive with the constituent elements of said aluminum salt in elemental form at said lower temperature.

6. In the process according to claim 5, wherein said liquid coolant comprises another salt containing only the said other element and another metal more chemically reactive than is aluminum at said lower temperature with said other element.

7. In the process according to claim 5, wherein heat which is removed in cooling said gas mixture by said liquid coolant is transferred to cooling coils in contact with said liquid coolant.

8. In the process according to claim 7, wherein a condensate film on said cooling coils acts as said liquid coolant for said gas mixture.

9. In the process according to claim 1, wherein said time interval of said flash cooling is not more than 0.001 to 0.1 seconds.

10. In the process according to claim 1, wherein heat removed in flash cooling said gaseous mixture is used to boil said liquid coolant.

11. In the process according to claim 10, wherein vapors formed in boiling said liquid coolant are condensed by a reflux condenser which condensate, so formed, is returned to the reservoir of said liquid coolant used in said flash cooling.

12. In the process according to claim 1, wherein said condensed aluminum is separated by physical means from said liquid coolant.

13. In the process according to claim 1, wherein said other element is one of the three lower halogens, and said aluminum salt is the corresponding tri-halide.

14. In the process according to claim 13, wherein said other element is chlorine and said liquid coolant contains aluminum tri-chloride.

15. In the process according to claim 13, wherein said liquid coolant comprises said aluminum tri-halide, and a halide of another metal higher than aluminum in the corresponding halogen affinity series.

16. In the process according to claim 15, wherein said liquid coolant comprises said aluminum trihalide and said halide of said other metal which are combined as a double salt.

17. In the process according to claim 15, wherein said liquid coolant comprises said aluminum trihalide combined as a chemical compound with said halide of said other metal.

18. In the process according to claim 17, wherein said chemical compound is cryolite.

19. In the process according to claim 1, wherein said high temperature is obtained through the production of a thermal plasma including said salt of aluminum.

20. In the process according to claim 1, wherein said aluminum which is condensed in said liquid coolant is in the liquid state.

* * * * *